US005342266A

United States Patent [19]

Dailey

[11] Patent Number: 5,342,266

[45] Date of Patent: Aug. 30, 1994

[54] SLALOM SKI TRAINER

[75] Inventor: Robert M. Dailey, Birmingham, Ala.

[73] Assignee: Dailey Sports, Inc., Birmingham, Ala.

[21] Appl. No.: 42,625

[22] Filed: Apr. 5, 1993

[51] Int. Cl.[5] ..... A63B 69/18; A63B 22/14

[52] U.S. Cl. ..... 482/71; 482/51; 482/79; 482/146

[58] Field of Search ..... 482/51, 71, 79, 146, 482/72, 73

[56] References Cited

U.S. PATENT DOCUMENTS

| | | | |
|---|---|---|---|
| 3,394,934 | 7/1968 | Elia et al. | 482/72 |
| 3,582,066 | 6/1971 | Keryluk | 482/71 |
| 3,834,693 | 9/1974 | Poppenberger | 482/71 |
| 4,386,915 | 6/1983 | Gilliam | 482/146 |
| 4,905,994 | 3/1990 | Hartz | 482/146 |
| 4,907,796 | 3/1990 | Roel-Rodriquez | 482/71 |
| 4,953,858 | 9/1990 | Zelli | 482/71 |

*Primary Examiner*—Richard J. Apley
*Assistant Examiner*—Lynne A. Reichard
*Attorney, Agent, or Firm*—Veal & Associates

[57] ABSTRACT

A slalom water-ski training device comprising a main channel member having a vertical upright member that is rigidly mounted substantially perpendicular thereto at one end thereof. At least two auxiliary support braces are connected at one end to the vertical upright member and connected at their opposite end to the main channel member. At least one stabilizing member is rigidly connected to and in substantial coplanar relation with the main channel member a proximate predetermined distance from the vertical upright member. A ski rope is detachably and reattachably connected to the vertical upright member at a free end distal the main channel member. A ski board is slidably and swivelly mounted to the main channel member. A resilient sliding resistance means is attached to the main channel member distal the vertical upright member and the ski board for the purpose of applying a substantially elastic resistance to the sliding longitudinal displacement of the ski board. An angle plate is pivotally mounted to the main channel member for varying the pitch angle of the ski board relative to the main channel member. The angle plate has a top and two sides, each side having a front portion and a rear portion. Each front portion has a plurality of coaxial apertures therein for insertion of a locking pin therethrough. Each rear portion has a coaxial aperture therein for insertion of a locking pin therethrough. The present invention also includes a strain gage connected to the free end of the vertical upright member for measuring a force exerted on the ski rope by a skier using the invention.

22 Claims, 4 Drawing Sheets

SLALOM SKI TRAINER

FIELD OF THE INVENTION

The present invention relates to water-ski training equipment and more particularly to a water-ski training device capable of realistically simulating the isometric phases of slalom water-skiing. In even greater particularity, the present invention relates to a water-ski training device having a pivotally, swivelly and slidably mounted ski board which allows the skier to perform precise isometric slalom body movements in order to improve endurance, technique, and agility.

BACKGROUND OF THE INVENTION

Muscular utilization by a skier must be analyzed during the three basic phases of slalom skiing: pull (acceleration), Edge change (deceleration), and turn.

The acceleration phase of slalom skiing, or the pull, is entered into just after a turn. Basically, the skier will use the pull on the rope to accelerate across the wakes. During this pull, the ski is on its cutting edge and the anatomical positioning of the skier's shoulders is erect facing square to the shore with the knees and ankles bent as far forward as possible. The handle is held close to the skier's body, preferably pressed against the outside hip with the arms slightly flexed. This action requires sustained isometric contraction of the quadriceps, gluteus maximus, latissimus dorsi, biceps, and forearm flexors. Proper body position is maintained by strong and continuous contraction of the recus abdominis, trapezius, back extensors, hip flexors, gluteus maximus, and the calf (gastrocnemius and soleus).

Just past the second wake the skier executes a maneuver called an edge change. The edge change marks the transition from the acceleration in the pull phase into the deceleration of the preturn phase. Deceleration refers to slowing the ski down in order to start the turn and changing the side or edge to its inside or turning edge. The preturn is characteristically a broad sweeping turn with little force on the rope. During the preturn the skier follows the arc of the rope using the ski force to overcome the radial acceleration of the curved path. During the preturn the skier is also using the drag of the ski to reduce speed.

The preturn ends at the apex of the path. At this point the skier's speed has slowed enough to be able to turn the ski in a tight radius. During the turn phase, the skier brings the ski around and prepares for the upcoming pull (or acceleration phase). In coming out of the turn, the boat begins to overtake the skier whose down course velocity decreased in the turn while the boat's down course velocity remained nearly constant. The force on the rope becomes greater and the skier once again enters the acceleration phase which propels the skier across the wakes toward the next turn buoy.

At present, there is no known satisfactory apparatus commercially available which can realistically or accurately simulate the sport of slalom water-skiing (i.e., what has been described heretofore). Almost all instances of instructive lessons pertaining to slaloming occur either orally or on a trial and error basis behind a boat.

Coaching of slalom water skiing is extremely subjective. Most coaching deals with body position and timing. Common coaching tips on body position are as follows: keep your knees bent, head looking across wakes, hips forward, shoulders back, arms straight, and hands close into the body. These tips are intended to provide the skier with a stable platform from which to handle the forces and accelerations of skiing. Coaching, however, is no substitute for actual physical training, whether it be on the water or by a ski trainer.

Various attempts, however, have been made to simulate water-skiing on dry land. Most of the earlier devices and methods were created for the purpose of teaching proper technique and/or maintaining muscle memory or shape during prolonged off-season periods. Unfortunately, these prior art devices and methods suffer many disadvantages or drawbacks. The most apparent disadvantage is the inability to realistically or precisely simulate slaloming, that is, inability to exercise the majority of muscle groups actually associated with slaloming in real life. Thus, most prior art devices or methods are limited to improper or incomplete techniques resulting in incomplete muscle group utilization.

For instance, one method requires the securing of a ski-rope to a stationary object. Facing the object, the skier attempts to consciously simulate body movements of slaloming by leaning backward hard against the rope. This method almost simulates skiing in a straight line. Although this is the strongest pulling position a skier's body can withstand, this method only works isolated muscles and not all muscle groups associated with slaloming.

Another endeavor reveals a prior art device with a base comprised of two elongated members connected at their ends so as to make a V-shape. A ski rope is attached at the point of intersection of the two base members. Attached perpendicularly to the base members is a stationary inclined foot board for simulating the act of slaloming. The foot board neither rotates nor slides. Again, since this device remains stationary, it fails to accurately simulate slaloming in that it only works isolated muscles and not all muscle groups associated with slaloming.

The above device also offers a trick ski swivel that can be mounted to the v-shaped base. The swivel does not involve slaloming. It does not slide nor is it inclined at an angle relative to the base members. Basically, the swivel teaches balance techniques as opposed to muscle workout associated with slaloming.

What is needed, and provided by the present invention, is an apparatus that will realistically and accurately simulate the sport of slalom water-skiing. While the above mentioned devices and methods are suited for their intended usage, none of these devices are capable of providing a new and improved slalom ski trainer.

SUMMARY OF THE PRESENT INVENTION

In view of the foregoing disadvantages inherent in the known types of ski trainers or dry land water-ski training methods, the present invention provides an improved slalom ski training device. As such, the principal object of the present invention, which will be described subsequently in greater detail, is to provide a new and improved slalom ski trainer which has all of the advantages of the prior art devices and methods and none of the disadvantages.

It is another object of the present invention to provide a new and improved ski training device which may be easily and efficiently manufactured and marketed.

It is a further object of the present invention to provide a new and improved ski training device which is of durable and reliable construction.

An even further object of the present invention is to provide a new and improved ski training device which is susceptible of a low cost of manufacture with regard to both materials and labor, and which is susceptible of low prices of sale to the consuming public, thereby making such ski training device economically available to the buying public.

Still another object of the present invention is to provide a new and improved ski training device for use by individuals performing water-skiing exercises. Even still another object of the present invention is to provide a new and improved ski training device which allows the skier to avoid spending valuable time on the water getting into slalom shape.

It is a further object of the present invention to simulate the isometric phases of water-ski slaloming on dry land.

Yet a further object of the present invention is to provide a new and improved slalom ski trainer that can be adjusted to accommodate different size skiers and can meet individual needs for training.

Even still a further object of the present invention is to provide a new and improved slalom ski trainer that will allow the skier to simulate slalom body movements thus building endurance and improving agility.

Finally, an object of the present invention is to allow the skier to train year round in order to minimize injuries and improve his/her overall cardiovascular health and standard of skiing so that the key fundamentals of slalom water skiing will become part of their muscle memory.

These and other objects are accomplished through the use of a horizontally disposed main channel member having a vertical upright member rigidly mounted substantially perpendicularly thereto at one end thereof. At least two auxiliary support rods are connected at one end to the vertical upright member and connected at their opposite end to the main channel member. At least one stabilizing member is rigidly connected to and in substantially coplanar relation with the main channel member at a predetermined distance from the vertical upright member. A ski rope is detachably connected to the vertical upright member at a free end distal the main channel member. A ski board is slidably and swivelly mounted to the main channel member. A resilient sliding resistance means is attached to the main channel member distal the vertical upright member and the ski board for the purpose of providing a substantially elastic resistance to the sliding longitudinal displacement of the ski board. An angle plate is pivotally mounted to the main channel member for varying the pitch angle of the ski board relative to the main channel member. The angle plate has a top and two sides, each side having a front portion and a rear portion. Each front portion has a plurality of alignable apertures therein for insertion of a locking pin therethrough. Each rear portion has a coaxial aperture therein for insertion of a locking pin therethrough. The present invention also includes a strain gage connected to the free end of the vertical upright member for measuring a force exerted on the ski rope by a skier using the invention. Note that the strain gage may also be mounted to the ski board to measure force applied thereto.

There has thus been outlined, rather broadly, the more important features of the invention in order that the detailed description thereof that follows may be better understood, and in order that the present contribution to the art may be better appreciated. There are, of course, additional features of the present invention that will be described hereinafter and which will form the subject matter of the claims appended hereto. In this respect, before explaining the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The foregoing objects and advantages of the present invention for a new and improved water-skiing training device will be more readily understood by one skilled in the art by referring to the following detailed description of a preferred embodiment and to the accompanying drawings which form a part of this disclosure, and wherein.

DETAILED DESCRIPTION OF A PREFERRED EMBODIMENT

Figure 1:
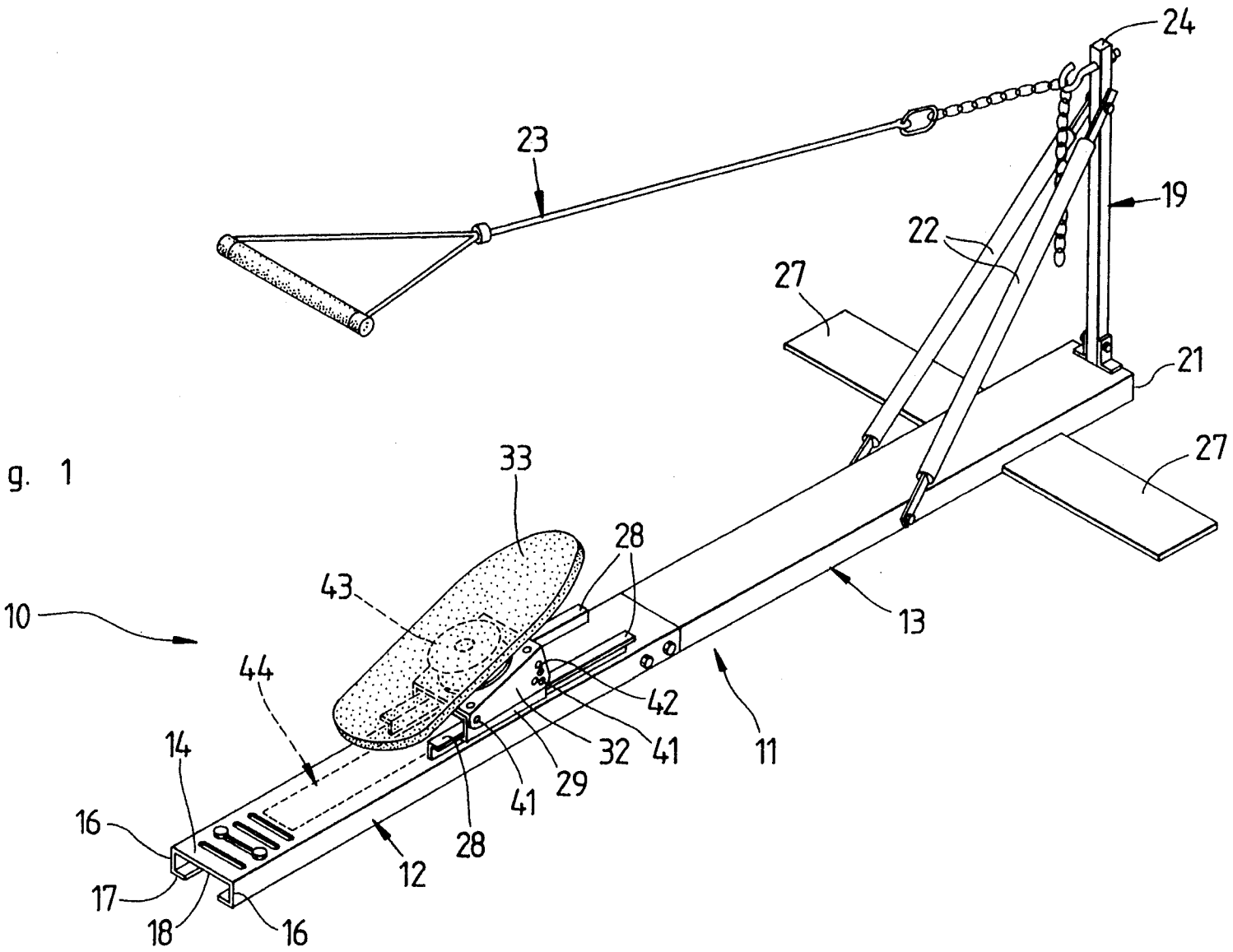
FIG. 1 is a perspective view showing a new and improved slalom ski trainer.
Figure 2:
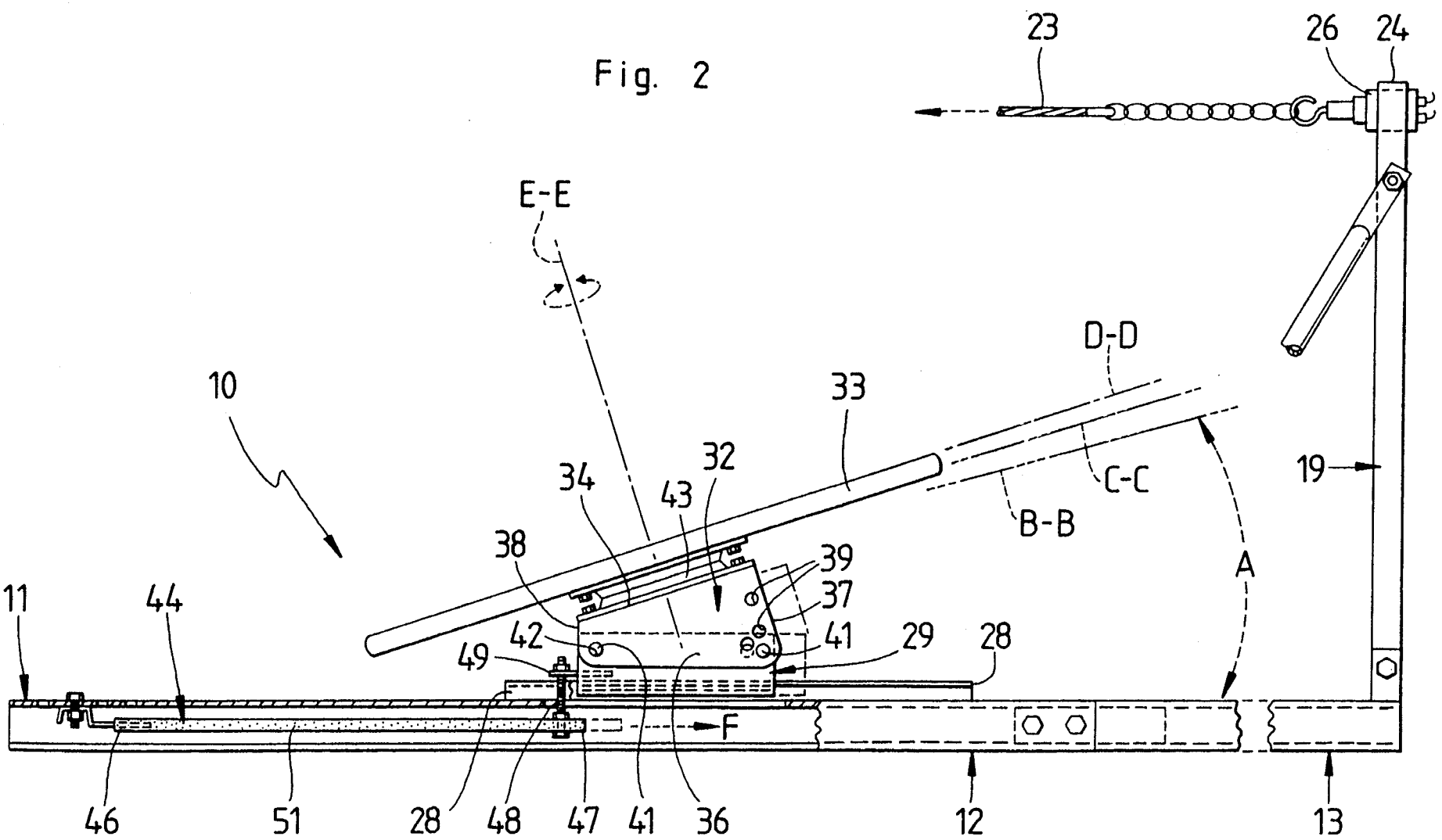
FIG. 2 is a side view of the new and improved slalom ski trainer.

Referring to the drawings for a clearer understanding of the present invention, it should be noted in FIG. 1 that the slalom ski trainer, which is the subject of this application, is shown generally at 10 and contemplates the use of an elongated rectangular main channel member 11. The main channel member 11 may be a flat plate, a metal or plastic extrusion, a type of a composite or even wood, or may be constructed from multiple pieces which are assembled upon each use of the invention. As shown in FIGS. 1 and 2, the main channel member 11 is comprised of two portions; a ski board portion 12 and a forward portion 13, the former being detachably and reattachably connected to and in substantially aligned relation with the later.

Figure 4:
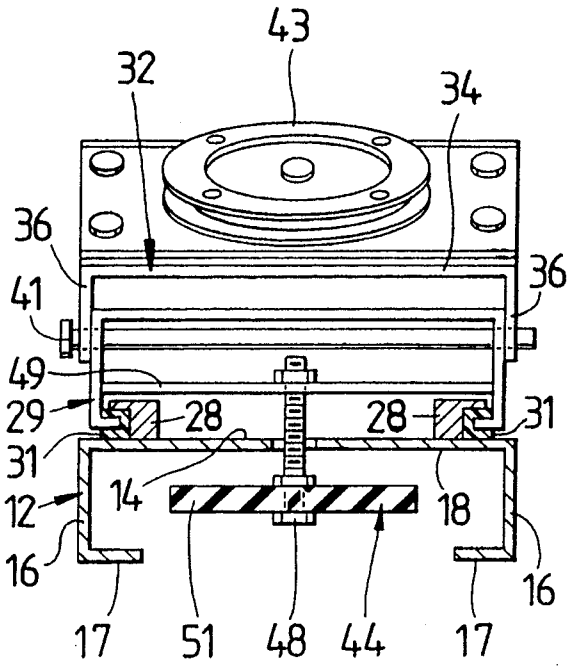
FIG. 4 is a sectional view of the new and improved slalom ski trainer taken along line 4—4 of FIG. 3.

In even greater particularity, as shown in FIGS. 1 and 4, the main channel member 11 may be constructed out of an extruded metal having a top 14, two sides 16 and a partial bottom 17 thus exposing an underside 18 of the top 14.

As shown in FIGS. 1 and 2, a vertical upright member 19 is rigidly connected to a free end 21 of the forward portion 13 of the main channel member 11. At least one auxiliary support brace 22 is attached at one end to the vertical upright member 19 and attached at its opposite end to the main channel member 11. The purpose of the support brace 22 is to provide additional support or leverage to the vertical upright member 19 since the present invention commonly encounters extreme forces during use thereof. Therefore, as a precautionary measure, FIG. 1 discloses two auxiliary support braces 22 attached at one end to the vertical upright member 19 and connected at their opposite ends on opposing sides 16 of the main channel member 11.

As shown in FIG. 1, a ski rope assembly 23 is detachably and reattachably connected to a free end 24 of the vertical upright member 19. Likewise, as shown in FIG. 2, a strain gage 26 is attached to the free end 24 of the vertical upright member 19 for measuring the pull force exerted on the ski rope 23 by a skier (not shown). Normally, the strain gage 26 will electrically and mechanically interface with a computer (not shown). Output from the strain gage 26, which is processed by a computer, is used as a teaching tool in order to enhance the technique of the skier.

As depicted in FIG. 1, at least one stabilizing member 27 is rigidly connected to and in perpendicular coplanar relation with the forward portion 13 of the main channel member 11 proximate the free end 21 of the forward portion 13. It provides additional stability to the slalom ski trainer 10 when in use. Alternative forms of stability enhancement are contemplated, such as reconfiguring the main channel member 11 into parallel or skewed base members (not shown) or a base that is constructed out of a flat plate (not shown).

As shown in FIGS. 1 and 4, at least two slide rails 28 are connected in substantial parallel relation to one another to the top 14 surface of the main channel member 11. Alternatively, the slide vails 28 may be an integral part of the main channel member 11. A slide member 29 slidably engages the slide rails 28. In order to reduce wear on the slide rails 28 and slide member 29 and to reduce friction therebetween, a wear strip 31 or any other type of lubricant or protective material or bearings may be included intermediate the slide rails 28 and slide member 29.

As shown in FIGS. 1, 2 and 4–6, an angle plate 32 is pivotally mounted onto the slide member 29 in order to vary the pitch angle or angle of inclination A of a ski board 33 relative to the main channel member 11. The angle plate 32 has a top 34 and two sides 36. Each side 36 has a front portion 37 and a rear portion 38. Both front portions 37 have a plurality of prearranged coaxially alignable apertures 39 therein for insertion of a locking pin 41 therethrough. Both rear portions 38 have at least one coaxially alignable aperture 42 therein for of a locking pin 41 therethrough.

As shown in FIGS. 2 and 4, a thrust bearing 43 is attached to the top 34 of the angle plate 32 in order to rotatably mount the ski board 33 to the angle plate 32. Since the angle plate 32 is pivotally mounted to the slide member 29, the ski board 33 will assume the same pitch angle A as the top 34 of the angle plate 32. At each separate pitch angle A, the ski board 33 defines a plurality of separate inclined planes B—B, C—C, D—D. The number of separate pitch angles A (and inclined planes) is a matter of choice.

This method of rotatably attaching the ski board 33 to the angle plate 32 allows the ski board 33 to rotate or swivel about an axis E—E normal to the inclined planes B—B, C—C or D—D.

As shown in FIGS. 2–6, a resilient sliding resistance means 44 is connected at one end 46 to the underside 18 portion of the main channel member 11. It is connected at the other end 47 via a known connector 48 to an interface portion 49 of the slide 29. Note that the strain gage 26 may alternatively be connected intermediate the stride member 29 and the sliding resistance means 44.

Figure 3:
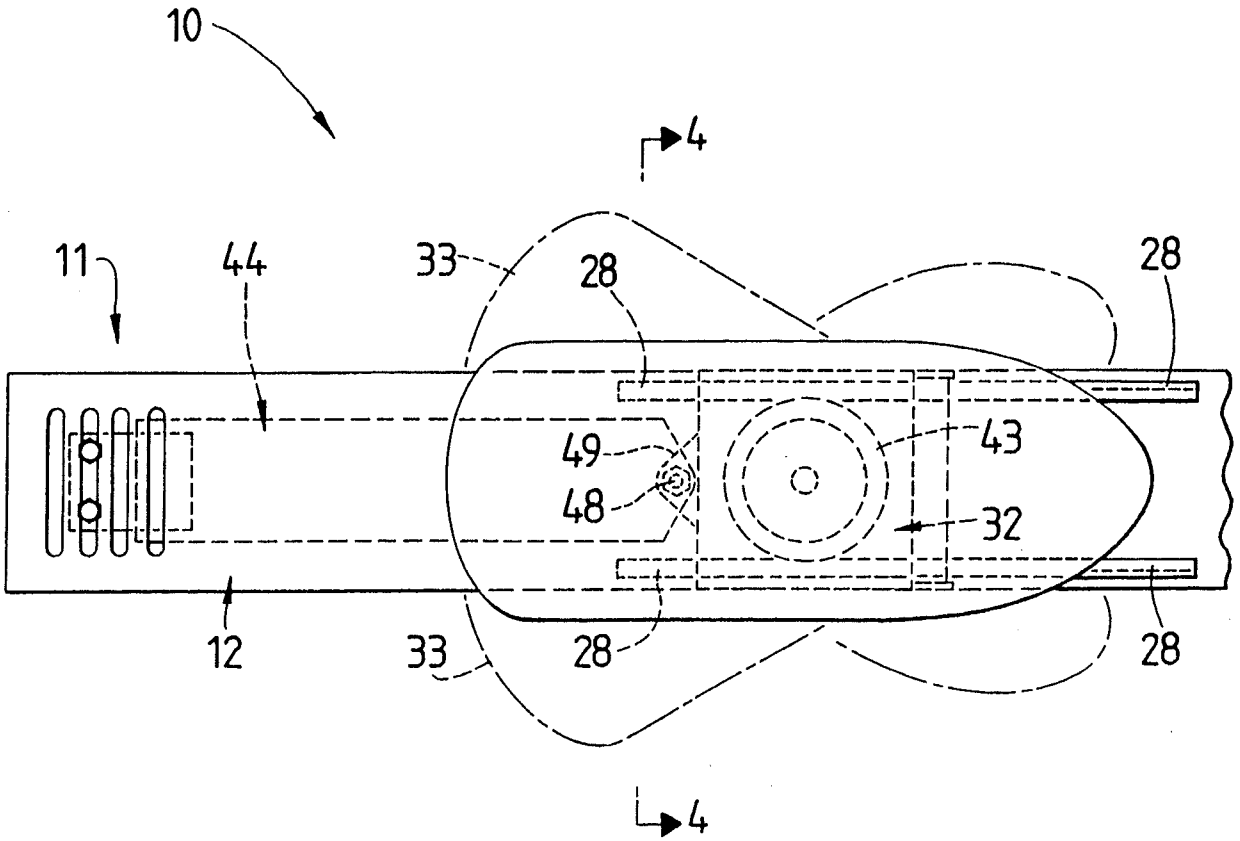
FIG. 3 is a top view of the new and improved slalom ski trainer.

Several types of sliding resistance means 44 may be utilized in the present invention. As shown in FIGS. 2–4, the resistance means 44 may be an elongated rubber strap 51.

In operation, the skier initially secures a firm grip on the ski rope 23. Using the ski rope 23 for maintaining balance, the skier positions his/her feet upon the ski board 33 in the same or very similar configuration as they would be in an actual water ski (i.e., with a preferred foot forward). The skier then proceeds to perform the isometric phases of a slalom turn, utilizing all muscle groups mentioned heretofore.

As shown in FIG. 2, during the various phases of the simulated turn, a sliding force F is placed on the rubber strap 51 by the skier simulating the turn. In response, the rubber strap 51 elastically resists sliding force F and will return the ski board 33 to its original position once sliding force F subsides, e.g., when the skier completes his/her workout or training.

Figure 6:
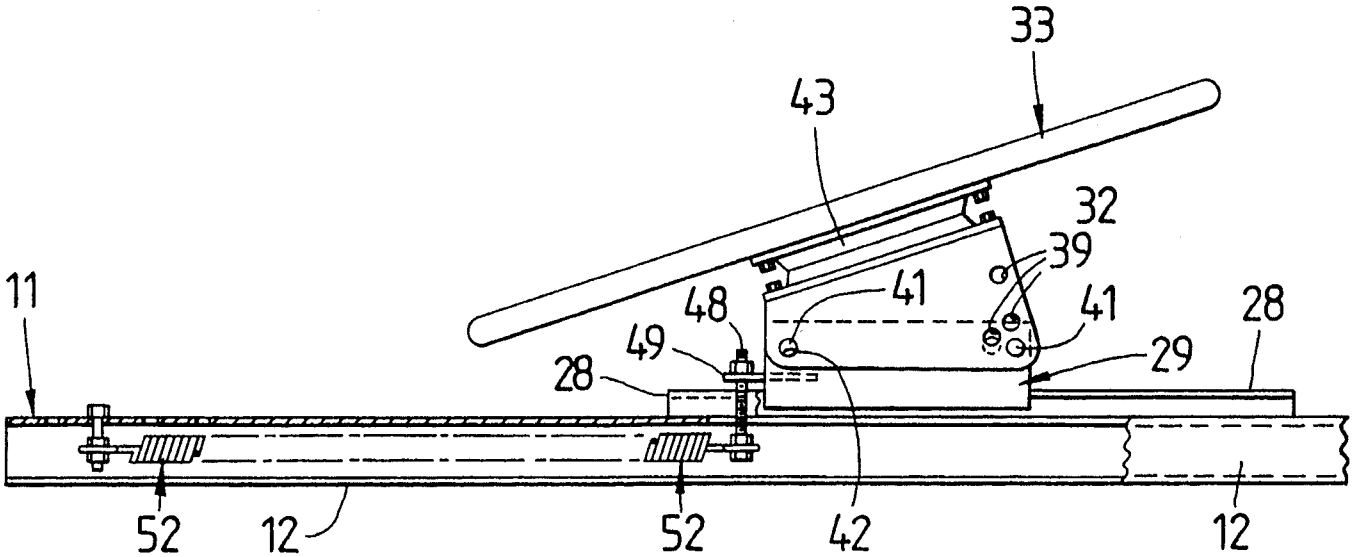
FIG. 6 is a side view of the new and improved slalom ski trainer showing the spring sliding resistance means.

An additional type of sliding resistance means 44 in the form of a spring 52 is disclosed in FIG. 6. Spring 52 functions similarly to rubber strap 51, the only difference being the amount of elasticity (i.e., tendency to return the ski board 33 to its original position).

Figure 5:
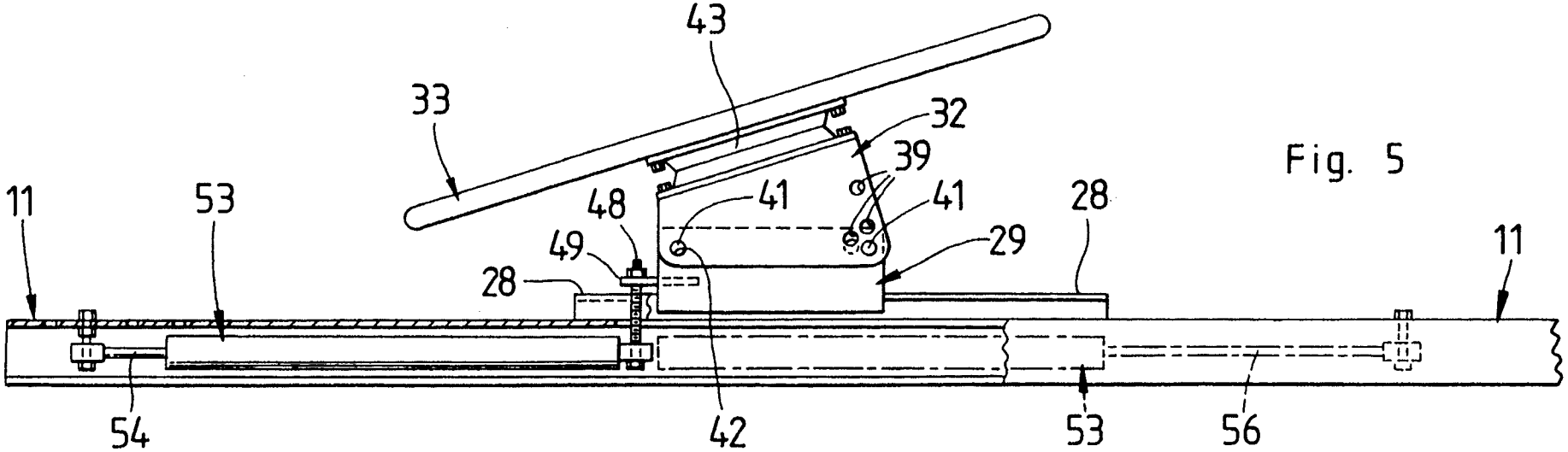
FIG. 5 is a side view of the new and improved slalom ski trainer showing the gas strut sliding resistance means.

FIG. 5 discloses another type of sliding resistance means 44 in the form of a gas strut 53 which may be used in place of the rubber strap 51 or spring 52. The only functional difference between the gas strut 53 and the strap 51 or spring 52 is that the strut 53 may be used either to tensionably resist force F, as shown at 54, or compressively resist force F, shown at 56, the difference being a matter of choice.

While a preferred embodiment of the present invention has been described in detail, such description is for illustrative purposes only, and it is to be understood that changes and variations may be made without departing from the spirit or scope of the following claims.

Having set forth the nature of the present invention, what is claimed is:

1. A water-ski training and exercise apparatus for simulating the isometric phases of slalom water-skiing and for toning certain muscle groups associated with engaging in such activity, said apparatus comprising:

(a) a generally horizontally disposed base member having a ski board mounted thereto;

(b) pitch varying means, connected between said base member and said ski board, for varying the angular pitch of said board defining an inclined plane for each angular pitch achieved;

(c) rotational attachment means, connected between said pitch varying means and said ski board, for rotatably mounting said ski board to said pitch varying means for rotation about an axis normal to said defined inclined plant; and, (d) sliding means, connected to said base member, for slidingly mounting said ski board to said base member.

2. An apparatus as defined in claim 1, further comprising a sliding resistance means, connected to said base member and said sliding means, for providing a resilient sliding resistance said sliding means.

3. An apparatus as defined in claim 2 wherein said sliding means comprises:

(a) at least two slide rails mounted on said base member in substantial parallel relation; and (b) a slide member which slidably engages said slide rails having a sliding resistance means interface portion connected thereto.

4. An apparatus as defined in claim 3 wherein pitch varying means comprises an angle plate pivotally mounted to said slide member having a top and two sides, each side having a front portion and a rear portion, each said front portion having a plurality of coaxially alignable apertures therein for insertion of a locking pin therethrough, each rear portion having a coaxially alignable aperture therein for insertion of a locking pin therethrough.

5. An apparatus as defined in claim 4 wherein said rotational attachment means comprises a bearing mount connected between said ski board and said top of said angle plate.

6. An apparatus as defined in claim 2 wherein said sliding resistance means comprises an elongated substantially elastic rubber strap connected at one end to said base member and connected at its opposite end to said sliding means.

7. An apparatus as defined in claim 2 wherein said sliding resistance means comprises a spring connected at one end to said base member and connected at its opposite end to said sliding means.

8. An apparatus as defined in claim 2 wherein said sliding resistance means comprises a gas strut connected at one end to sadi base member and connected at its opposite end to said sliding means.

9. An apparatus as defined in claim 2 further comprising a ski rope detachably connected to a free end of said base member.

10. An apparatus as defined in claim 2 further comprising at least one stabilizing member rigidly connected to an in substantially perpendicular coplanar relation with said base member proximate said free end thereof.

11. A water-ski training and exercise apparatus for simulating the isometric phases of slalom water-skiing and for enhancing certain muscle group memory associated with engaging in such activity, said device comprising:

(a) a base having a ski board slidably and swivelly mounted thereto;

(b) hand interface means, connected to said base, for allowing a skier's hands to interface with said apparatus;

(c) resilient sliding resistance means, attached to said base and to said ski board, for providing a substantially elastic resistance to sliding longitudinal displacement of said ski board; and (d) adjustable inclination means, attached between said base and said ski board, for variably inclining said ski board relative to said base to position said ski board on a selected inclined plane.

12. An apparatus as defined in claim 11 wherein said base further comprises:

(a) at least two slide rails in substantial parallel relation mounted thereon; and (b) a slide member which slidably engages said slide rails having a sliding resistance means interface portion connected thereto.

13. An apparatus as defined in claim 12 wherein said adjustable inclination means comprises an angle plate pivotally mounted to said slide member for varying the angle of inclination of said ski board relative to said base; said angle plate having a top and two sides, each side having a front portion and a rear portion, each said front portion having a plurality of coaxially alignable apertures therein for insertion of a locking pin therethrough, each rear portion having a coaxially alignable aperture therein for insertion of a locking pin therethrough.

14. An apparatus as defined in claim 13 wherein said resilient sliding resistance means comprises an elongated substantially elastic rubber strap connected at one end to said base and connected at it opposite end to said sliding resistance means interface portion of said slide member.

15. An apparatus as defined in claim 14 further comprising an upright member connected to said base for attachment of said hand interface means thereto.

16. An apparatus as defined in claim 15 further comprising at least one stabilizing member rigidly connected to and in substantial coplanar relation with said base proximal said upright member.

17. An apparatus as defined in claim 13 wherein said resilient sliding resistance means comprises a spring connected at one end to said base and connected at its opposite end to said sliding resistance means interface portion of said slide member.

18. An apparatus as defined in claim 13 wherein said resilient sliding resistance means is attached to said base proximate said upright member and ski board for applying a substantially elastic compressive resistance to sliding displacement of said ski board.

19. An apparatus as defined in claim 18 wherein said resilient sliding resistance means comprises a gas strut connected at one end to said base proximate said upright member and connected at its opposite end to said sliding resistance means interface portion of said slide member.

20. An apparatus as defined in claim 13 further comprising a bearing mount intermediate said ski board and said top of said angle plate for swiveling said ski board about an axis normal to said selected inclined plane.

21. A water-ski training and exercise apparatus for simulating the isometric phases of slalom water-skiing and for toning certain muscle groups associated with such activity, said apparatus comprising:

(a) a main channel member having a vertical upright member rigidly mounted substantially perpendicular hereto at one end thereof;

(b) at least tow auxiliary support braces connected at one end to said vertical upright member and connected at an opposite end to said main channel member;

(c) at least one stabilizing member rigidly connected to an in substantial coplanar relation with said main channel member proximate said vertical upright member;

(d) a ski rope detachably connected to said vertical upright member at a free end distal said main channel member;

(e) a ski board slidably and swivelly mounted to said main channel member;

(f) resilient sliding resistance means, attached to an underside of said main channel member distal said vertical upright member and to said ski board, for applying a substantially elastic resistance to sliding longitudinal displacement of said ski board; and (g) an angle plate pivotally mounted to said main channel member for varying the pitch angle of said ski board relative to said main channel member; said angle plate having a top and two sides, each side having a front portion and a rear portion, each said front portion having a plurality of coaxially alignable apertures therein for insertion of a locking pin therethrough, each rear portion having a coaxially alignable aperture therein for insertion of a locking pin therethrough.

22. An apparatus as defined in claim 21 further comprising a strain gage operatively connective to said apparatus for measuring a force exerted on said apparatus by a skier engaging said apparatus.

* * * * *